US005186988A

United States Patent [19]

Dixon

[11] Patent Number: 5,186,988

[45] Date of Patent: Feb. 16, 1993

[54] GIFT WRAPPING

[76] Inventor: Merle Dixon, 2624 N. Steadman Dr., Petersburg, Va. 23803

[21] Appl. No.: 623,560

[22] Filed: Dec. 7, 1990

[51] Int. Cl.[5] ..... B65B 53/02; B65D 30/10

[52] U.S. Cl. ..... 383/37; 428/35.2; 428/34.3; 428/43; 428/906; 428/34.9; 229/87.19; 383/71; 383/77; 206/497; 206/390

[58] Field of Search ..... 428/906, 43, 101, 34.3, 428/35.2, 192, 34.9, 81, 212; 229/923, 87; 383/62, 70, 71, 72, 37, 105; 206/497, 457, 390

[56] References Cited

U.S. PATENT DOCUMENTS

| | | | |
|---|---|---|---|
| D. 156,059 | 11/1949 | Vivaudou | D58/2 |
| 3,363,828 | 1/1968 | Foglia et al. | 229/62 |
| 3,912,100 | 10/1975 | Graham et al. | 215/12 |
| 4,274,900 | 6/1981 | Mueller et al. | 156/229 |
| 4,542,676 | 9/1985 | Carlson et al. | 84/94 C |
| 4,608,283 | 8/1986 | White | 428/4 |
| 4,777,066 | 10/1988 | White | 428/4 |
| 4,787,517 | 11/1988 | Martin | 206/610 |
| 4,996,087 | 2/1991 | Rebstock | 428/11 |

*Primary Examiner*—Ellis P. Robinson
*Assistant Examiner*—Charles R. Nold
*Attorney, Agent, or Firm*—Terry M. Gernstein

[57] ABSTRACT

Gift wrapping material is formed in a monolithic, one-piece body of undefined, length. The body is divided into a plurality of bag-forming sections by tear lines, and each tear line is spaced from an adjacent tear line so that tear-off strips are formed when two adjacent tear lines are torn. A tear-off strip is used to tie a bag closed. The bag-forming sections are formed of multiply plastics type material, and some sections of each bag are formed so that application of hot air thereto will cause those sections to shrink to a greater degree than adjacent sections to permit a bag to snugly enclose a multi-cornered package.

10 Claims, 2 Drawing Sheets

GIFT WRAPPING

TECHNICAL FIELD OF THE INVENTION

The present invention relates to the general art of packaging, and to the particular field of gift wrapping.

BACKGROUND OF THE INVENTION

Gift giving is a very popular tradition employed for many special occasions. Most people, at one time or another, have given a gift to someone else.

While gift giving is enjoyable, many people consider gift wrapping an onerous task. Wrapping paper is often quite expensive and can be difficult to manipulate for some people, especially those whose hands may be impaired, as by arthritis or the like. This can result in wasted materials as well as wasted effort and, perhaps, a degrading of the gift itself due to an unorderly appearance of the wrapped gift.

For this reason, many stores and businesses offer some sort of gift-wrapping services for their customers. The art also contains examples of gift wrapping kits which include wrapping paper and ties in a single package. However, both the gift-wrapping services and the kits have drawbacks. The services can be expensive, either to the store owner or to the customer, and the kits can still be difficult to use since the wrapping paper must still be manipulated.

The odd shape of many packages have odd shapes with many corners and angles further exacerbates the above-discussed problems for those who find it difficult to wrap packages. Still further, even if a package is wrapped, it is often difficult to keep a tie ribbon together with the wrapping paper during storage and such ribbons are often lost thereby adding to the frustration of a gift wrapper.

Therefore, there is a need for gift wrapping which is convenient to use, convenient to store, and can easily accommodate odd-shaped packages as well as have all of the materials in a single location.

OBJECTS OF THE INVENTION

It is a main object of the present invention is to provide gift wrapping which is convenient to use.

It is another object of the present invention to provide gift wrapping which is convenient to use and is also convenient to store.

It is another object of the present invention to provide gift wrapping which is convenient to use, and can easily accommodate odd-shaped packages.

It is another object of the present invention is to provide gift wrapping which is convenient to use as well as have all of the materials in a single location.

SUMMARY OF THE INVENTION

These, and other, objects are achieved by gift wrapping that is formed and sold as a roll of undefined length and which includes a body having a forward end and a rear end and which is divided transversely by a plurality of spaced apart tear lines. The tear lines are formed in pairs which are closely adjacent to each other, and which define bag-forming sections between adjacent pairs and tear-off strips between adjacent tear lines. The tear-off strips are attached to the bottom edge of one bag-forming section and to the top edge of an adjacent bag-forming section and extend widthwise across the body. The tear-off strips are the ties that will be used to close a bag about a package.

The body is formed of flexible material, such as polyethylene plastic, or the like, and can include corners that are formed of heat-shrinkable material that shrinks upon the application of heated air, as from a hand-held hot air dispensing hair dryer, or the like. The body also includes decorative indicia on at least one side thereof.

The tear-off strips can be formed of material that is the same or different from the rest of the body, and can have the ends thereof separate or connected by a tear line so the tear-off strip is approximately twice as long as measured between its end, as the body is wide as measured between its side edges.

The body is stored in a roll form and is dispensed from the roll. The bags and the associated tear-off strips are torn off of the body as needed, and the bags placed about a package to be wrapped. If the bag does not neatly and snugly fit about the package being wrapped, hot air can be applied to various locations thereon to shrink the bag about the package thereby forming a neatly-wrapped package.

In this manner, a package, even an odd-shaped package, can be easily wrapped in a manner that presents a neat appearance using materials that are easily manipulated, even by one having impaired hand coordination or by one having little or no skill at wrapping packages. Still further, all of the materials that are required to wrap a package are stored in a single location and thus are not likely to be lost and unavailable when a user is wrapping packages.

BRIEF DESCRIPTION OF THE DRAWING FIGURES

DETAILED DESCRIPTION OF THE PREFERRED EMBODIMENT OF THE INVENTION

Figure 1:
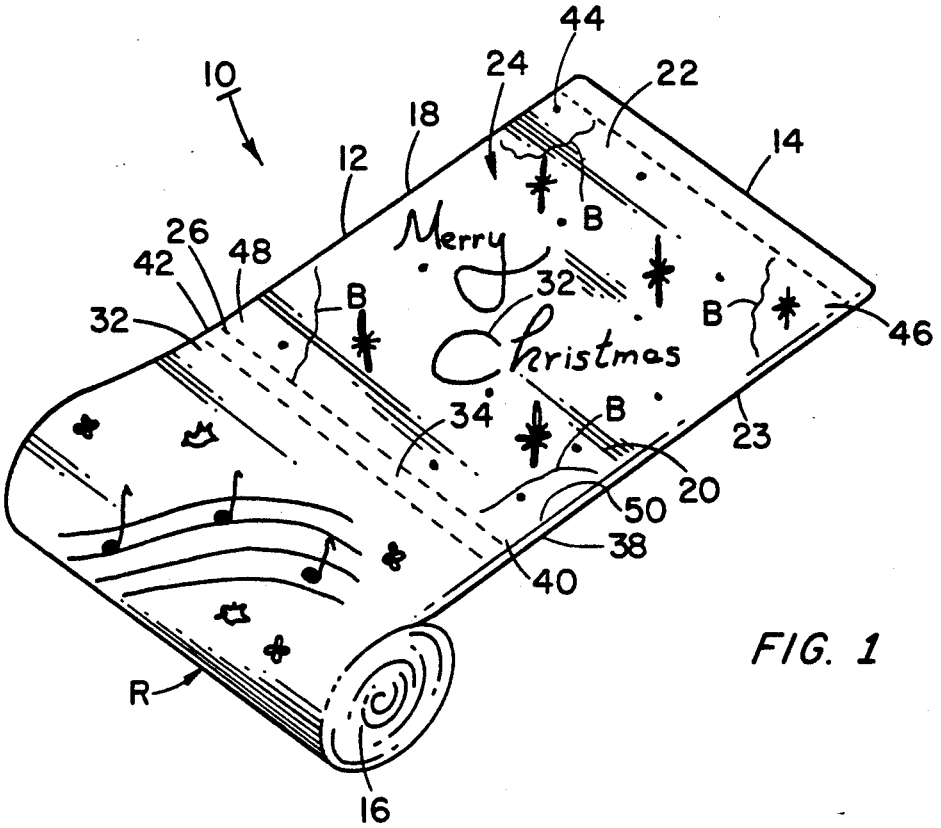
FIG. 1 is a perspective view of a roll of gift wrapping material as embodied in the present invention.

Shown in FIG. 1 is a quantity of gift wrapping 10 embodying the present invention. The gift wrapping is formed of a flexible material, such as polyurethane, having an undefined length and is stored in the form of a roll R as shown in FIG. 1. The gift wrapping has a monolithic, one-piece body 12 having a forward end edge 14 and a rear end edge 16 that is located at the center of the roll shown in FIG. 1, but can be at other locations if other forms of rolls are used.

The body 12 has side edges 18 and 20, and a width dimension as measured transversely thereof from one side edge to the other. The length dimension of the is measured between the leading end edge and the rear end edge.

The body further includes an outer sheet 22 and an inner sheet 23 which are connected together along the side edges 18 and 20 to form a tube into which packages can be placed.

The body is divided into a plurality of bag-forming sections, such as bag-forming section 24 by a multiplicity of tear lines, such as tear line 26 which extend widthwise across the body from one side edge to the other. The tear lines are formed of a plurality of perforations that extend completely through both the inner and the outer sheets whereby the bag-forming sections can be torn off of the body.

Figure 2:
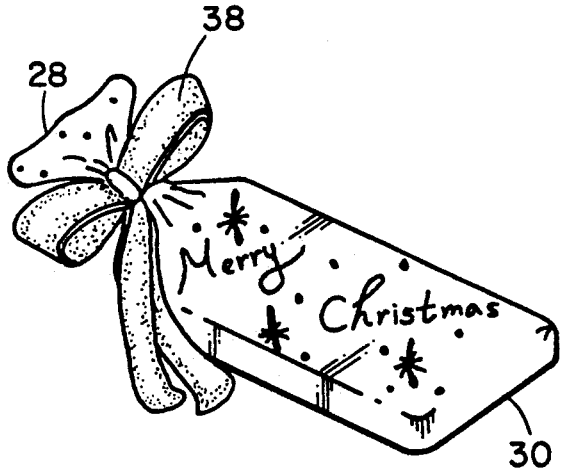
FIG. 2 is a perspective view of a package that has been wrapped using a bag from the roll of gift wrapping material shown in FIG. 1.

The body inner sheet is securely connected to the body outer sheet adjacent to each tear line 26 to form a closed bottom edge for each bag when the bag is torn off of the roll. Each bag is thus closed on three sides thereof, the bottom and both sides, and is open at the top edge thereof, as best shown in FIG. 2 at top edge 28 and at bottom edge 30.

The body further includes decorative indicia, such as decorations 32 on the outer and inner sheets, and such decorations can be any suitable motif, such as the Christmas motif shown, birthday motif, wedding motif, or the like.

A plurality of further tear lines, such as tear line 32 are formed in the body to extend widthwise across the body from one side edge to the other through both the inner and the outer sheets as indicated in FIG. 1. The tear lines 32 are located rearwardly adjacent to each tear line 26 and are spaced apart therefrom along the length dimension of the body. The tear lines 32 also are formed of a plurality of perforations which extend through the inner and the outer sheets of the body.

The body inner and outer sheets are not connected to each other adjacent to the tear lines 32 and thus an open mouth for a bag is formed rearwardly adjacent to each tear line 32 whereas a closed bag bottom is formed forwardly adjacent to each tear line 26.

A tear-off strip 34 is defined between adjacent tear lines 26 and 32. The tear-off strips 34 are thus spaced apart from each other along the length dimension of the body, and are used to form the bag-closing tie 36 shown in FIG. 2. Each tear-off strip includes a first edge 38 and a second edge 40 which are both located on a single body side edge, such as body side edge 20 and are coincident with each other and located to be collinear and part of that body side edge 20. The tear-off strip further includes a midsection 42 which is located to be collinear with and part of the other body side edge 18. The tear-off strips are all monolithic and one-piece so that the overall length dimension thereof as measured between the first and second edges 38 and 40 is approximately twice as long as the body is wide. The monolithic and one-piece nature of the tear-off strips provides them with added strength and combines with the monolithic and one-piece nature of the overall body to make manufacture of the gift wrapping 10 easier and more efficient.

The tear-off strips 34 thus separate adjacent bag-forming sections from each other with each bag-forming section having closed sides and a closed bottom and an open top. The tear-off strips are then opened up to form the tie 36 shown in FIG. 2 to close the bag after a package is placed in that bag.

The tear-off strips can include decorative indicia that is similar to or different from the decorative indicia 32. Or, the tear-off strips can be a different color from the remainder of the body, as indicated in FIG. 2 so the tie 36 will be decorative. Furthermore, in one embodiment, the tear-off strips are formed of material that is different from the material forming the remainder of the body. Thus, in one form of the invention, the bag-forming sections are formed of polyurethane, and the tear-off strips are formed of cloth, such as silk or the like, or paper and can be bonded to material, such as plastics-type material, or the like, which forms one portion of the tear line.

Furthermore, in one form of the invention, the tear-off strip end edges 38 and 40 are not connected to each other so that the tear-off strip is easily unfolded after it has been separated from the remainder of the body. In another form of the invention, the tear-off strip end edges 38 and 40 are connected together by a tear line, similar to the perforated lines 26 and 32 and are opened after the tear-off strip has been removed from the remainder of the body.

As indicated in FIGS. 1 and 2, each bag-forming section includes two top corners 44 and 46 formed rearwardly adjacent to the intersection of the rearward tear line 32 located forwardly adjacent to the bag-forming section top edge and the body sides 18 and 20, and two bottom corners 48 and 50 formed forwardly adjacent to the intersection of the bag-forming section rear edge and the body sides 18 and 20.

In the event that a package being wrapped has an odd shape or if a user wishes to encase a package in a tight and secure manner, one form of the invention includes material in such corners that is heat shrinkable upon the application of hot air as from a hand-held hair dryer or the like. This heat-shrinkable material will loosely accommodate the package, and will then snugly engage such package as it shrinks upon being contacted with hot air. A snug and tight fit is thus easily effected for a package, even if the package has an odd shape. Suitable heat shrinkable materials are well known in the art, and are often of the heat shrinkable materials used to form the corners 44–50 will not be discussed. The remainder of the body material does not shrink as much as do the corners upon the application thereto of hot air, and the limits of the corner heat shrinkable material are indicated in FIG. 1 by the boundary lines B.

Figure 3:
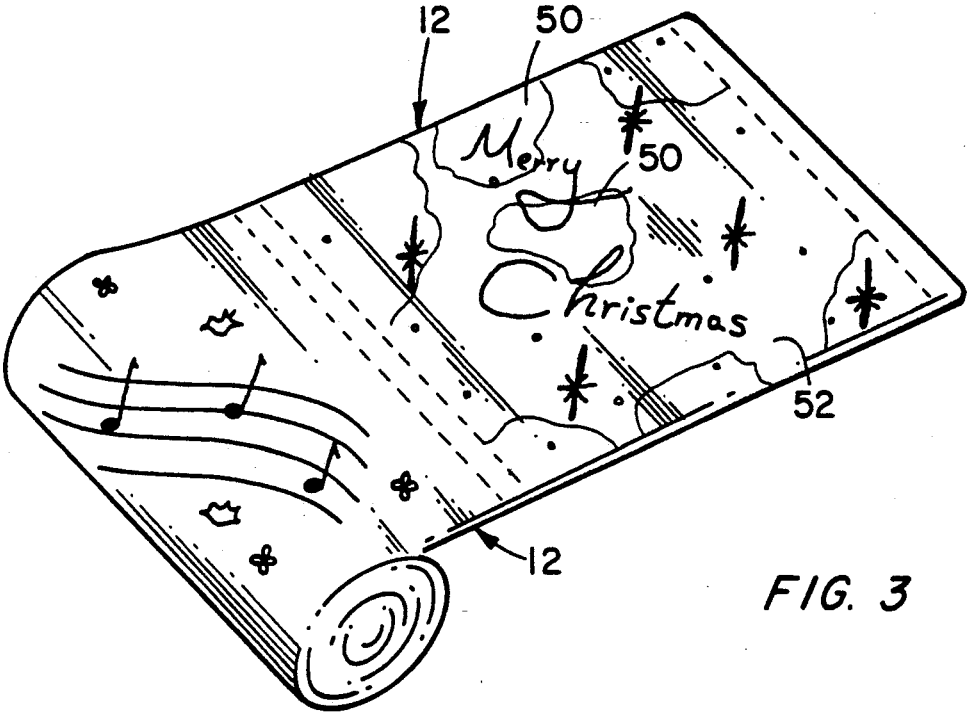
FIG. 3 is a perspective view of a form of the invention which includes several areas which can be heat shrunk onto a multicornered package.
Figure 4:
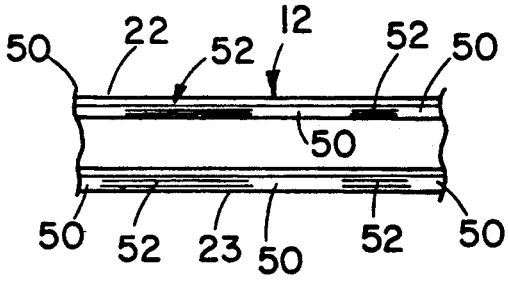
FIG. 4 is a cross-sectional view of the FIG. 3 form of the invention showing several plys of plastic film in areas adjacent to the heat shrinkable areas.

An alternative form of the invention is shown in FIGS. 3 and 4 in which the polyethylene plastic material has several locations which can be heat shrunk using the application of hot air so the final package will snugly fit an odd shaped package The material 12' shown in FIG. 3 includes areas 50 which have only a two ply thickness of material on the outer sheet 22 and on the inner sheet 23 at areas 50; whereas, these sheets have multi-ply thicknesses at areas 52 other than and adjacent to the areas 50. Thus, the application of heat to the bag may cause all areas to shrink, however, the areas 50 will shrink more than the adjacent areas 52 due to the multi-ply thickness of the areas 52 adjacent to the areas 50. In this manner, the entire bag will shrink and thus fit snugly about a package, however, certain areas will shrink more than other areas and be snugger in certain areas of the package.

Use of the wrapping material is evident from the foregoing discussion, and thus will be only briefly discussed. A bag section is removed from the roll by tearing off that bag section along tear line 32. The tear-off strip is removed from the removed bag by tearing along line 26. A package is then inserted into the bag, and the bag mouth tied using the tear-off strip 36. A hand-held hair dryer is then used to blow hot air onto certain portions of the package and shrink the bag about the package in a manner which presents a neat appearance.

It is understood that while certain forms of the present invention have been illustrated and described herein, it is not to be limited to the specific forms or arrangements of parts described and shown.

I claim:

1. Gift wrapping comprising:

a monolithic, one-piece tubular body of undefined extent having a forward end edge and a rear end edge;

two side edges;

a width dimension extending between said side edges;

a length dimension defined between said forward end edge and said rear end edge;

an outer sheet;

an inner sheet;

said body being divided into a multiplicity of bag-forming sections, each bag-forming section having a bottom edge and a top edge located forwardly of said bag-forming section bottom edge, and bag-forming section side edges which extend from said bag-forming section top edge to said bag-forming section bottom edge and which are coincident with said body side edges, said body outer sheet being connected so said body inner sheet at each bag-forming section side edge and along said bag-forming section bottom edge, each bag-forming section further including four corners, which include two top corners located adjacent to an intersection of a bag-forming section top edge and said bag-forming section side edges and two bottom corners located adjacent to an intersection of a bag-forming section bottom edge and said bag-forming section side edges, a heat-shrinkable section adjacent to each bag-forming section corner, and non-heat shrinkable material between said heat-shrinkable sections;

a plurality of forward tear lines extending widthwise of said body, said forward tear lines being spaced apart from each other along the length dimension of said body and each including a plurality of perforations and being located immediately adjacent to and rearwardly of a bag-forming section bottom end edge whereby each bag-forming section can e torn off of said body and will have closed sides at the side edges thereof, a closed bottom at the bottom edge thereof and an open mouth defined at the top end edge thereof;

a plurality of rearward tear lines extending widthwise of said body, each of said rearward tear lines being spaced apart from one of said forward tear lines along the length dimension of said body and each rearward tear line including a plurality of perforations and being located immediately adjacent to and forwardly of a rearwardly adjacent bag-forming section top end edge and being located rearwardly spaced along said body length dimension from a forwardly adjacent forward tear line and defining with said forwardly adjacent tear line a tear-off strip, said tear-off strip including first and second end edges which are coincident with each other and with one of said body side edges, and a midsection which is coincident with another of said body side edges, each; of said tear-off strips being monolithic and one-piece and having a length as measured between said tear-off strip first and second edges which is approximately twice the width dimension of said body; and said bag-forming section to edges being tearably connected to a forwardly adjacent rearward tear line and each of said body section bottom edges being tearably connected to a rearwardly adjacent one of said forward tear lines so that each bag-forming section is separated from adjacent bag-forming sections by a tear-off strip.

2. The gift wrapping defined in claim 1 further including decorative indicia on said body outer sheet.

3. The gift wrapping defined in claim 2 further including decorative indicia on said body inner sheet.

4. The gift wrapping defined in claim 3 wherein said tear-off strip first and second end edges are unconnected with each other.

5. The fit wrapping defined in claim 3 further including an edge tear line tearably connecting said tear-off strip first and second end edges together, said edge tear line being co-linear with and part of said one body side edge and including a plurality of perforations.

6. The gift wrapping defined in claim 3 wherein said body is formed of multi-ply polyethylene material.

7. The gift wrapping defined in claim 6 wherein said tar-off strip is of a color which is different from the color of said bag-forming section.

8. The gift wrapping defined in claim 7 wherein said tear-off strip is formed of cloth material.

9. The gift wrapping defined in claim 8 further including additional heat-shrinkable sections adjacent to said corners.

10. The gift wrapping defined in claim 9 wherein said heat-shinkable sections are formed of fewer plys than said bag body adjacent to said heat-shrinkable sections.

* * * * *